US009198460B2

(12) United States Patent
Tritz et al.

(10) Patent No.: US 9,198,460 B2
(45) Date of Patent: Dec. 1, 2015

(54) DEVICE FOR TREATING A SMOKING ARTICLE

(71) Applicant: PHILIP MORRIS PRODUCTS S.A., Neuchatel (CH)

(72) Inventors: Dorothy Tritz, Yverdon-les-Bains (CH); Antoine Perignon, Montreux (CH)

(73) Assignee: Philip Morris Products S.A., Neuchatel (CH)

( * ) Notice: Subject to any disclaimer, the term of this patent is extended or adjusted under 35 U.S.C. 154(b) by 84 days.

(21) Appl. No.: 14/353,837

(22) PCT Filed: Nov. 1, 2012

(86) PCT No.: PCT/EP2012/071663

§ 371 (c)(1),
(2) Date: Apr. 24, 2014

(87) PCT Pub. No.: WO2013/064600

PCT Pub. Date: May 10, 2013

(65) Prior Publication Data

US 2014/0251357 A1 Sep. 11, 2014

(30) Foreign Application Priority Data

Nov. 1, 2011 (EP) ..... 11250877

(51) Int. Cl.
*A24F 25/02* (2006.01)
*A24F 25/00* (2006.01)
(Continued)

(52) U.S. Cl.
CPC ..... *A24C 5/608* (2013.01); *A24D 3/048* (2013.01); *A24F 25/00* (2013.01); *A24F 25/02* (2013.01)

(58) Field of Classification Search
CPC ..... A24C 5/608; A24F 25/00; A24F 25/02
USPC ..... 131/335
See application file for complete search history.

(56) References Cited

U.S. PATENT DOCUMENTS 3,545,453 A 12/1970 Hoffman
3,732,872 A 5/1973 Lakritz
(Continued)

FOREIGN PATENT DOCUMENTS

DE 100 52 409 11/2011
EP 0272 852 6/1988
WO WO 2009/027832 3/2009

OTHER PUBLICATIONS

European Search Report for Application No. 11250877.5 (5 pages).
(Continued)

*Primary Examiner* — Anthony Calandra
(74) *Attorney, Agent, or Firm* — Mueting, Raasch & Gebhardt, P.A.

(57) ABSTRACT

A device (10) for treating at least a portion of a smoking article comprises: a base unit (12) including: one or more elongate chambers (16) for receiving at least a portion of a smoking article and one or more air plenums (22) in fluid communication with at least one of the one or more elongate chambers (16), wherein the one or more air plenums (22) comprises one or more annular channels, the one or more annular channels surrounding the elongate chambers (16) along at least a part of the length of the elongate chambers (16); a treatment unit (26) including one or more reservoirs (32) for containing a liquid treatment agent, wherein each reservoir (32) comprises means (36) for providing fluid communication with an inlet (24) of the one or more air plenums (22); and aerosol generating means (40) connected to the treatment unit (26) for forming an aerosol from the liquid treatment agent in the one or more reservoirs (32).

19 Claims, 1 Drawing Sheet

Figure 1:
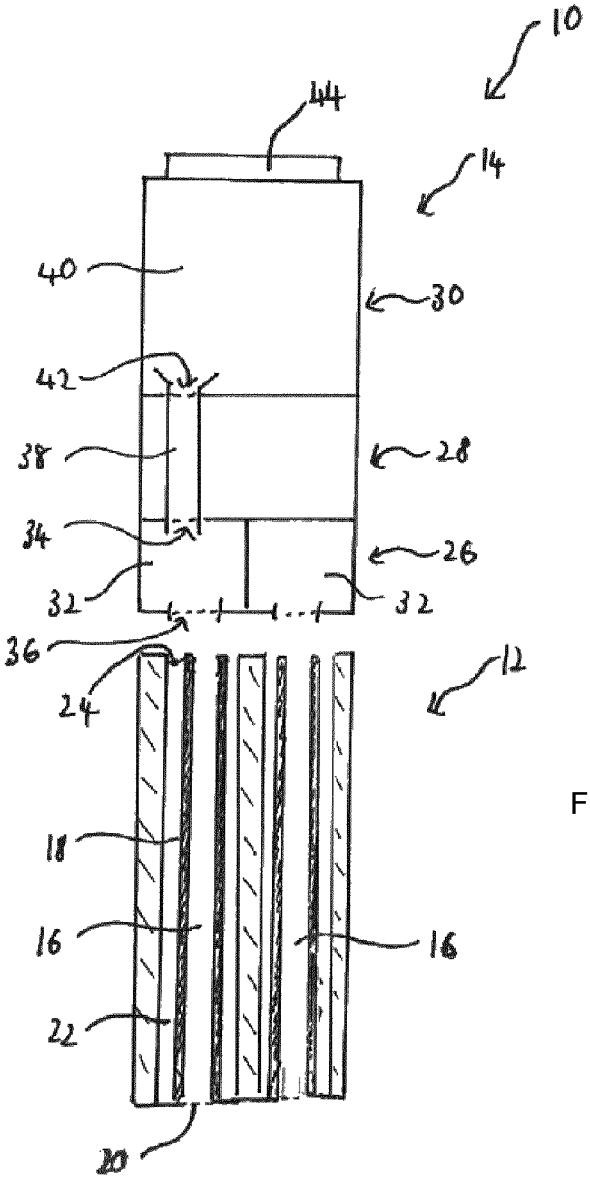

(51) Int. Cl.
*A24C 5/60* (2006.01)
*A24D 3/04* (2006.01)

(56) References Cited

U.S. PATENT DOCUMENTS 4,233,995 A 11/1980 Kotuby
6,263,881 B1 * 7/2001 Kuhl ..... A24C 5/1892 131/280
2010/0132723 A1 6/2010 McKamy
2011/0067713 A1 * 3/2011 Egued ..... A24F 25/02 131/250

OTHER PUBLICATIONS

PCT International Search Report and Written Opinion dated Mar. 1, 2013 for PCT/EP2012/071663 (11 pages).

* cited by examiner

DEVICE FOR TREATING A SMOKING ARTICLE

This application is a U.S. National Stage Application of International Application No. PCT/EP2012/071663, filed Nov. 1, 2012, which was published in English on May 10, 2013 as International Patent Publication WO 2013/064600 A1. International Application No. PCT/EP2012/071663 claims priority to European Application No. 11250877.5 filed Nov. 1, 2011.

The present invention relates to a device for treating a smoking article or a portion of a smoking article and in particular to a device which provides one or more available treatment agents which can be selectively applied to a smoking article or portion of a smoking article. The invention finds particular application as a device for flavouring a smoking article or a portion of a smoking article.

The use of liquid flavourants to incorporate additional flavours to a smoking article is well known. Such flavourants may be used to enhance the tobacco flavours in the mainstream smoke or provide additional non-tobacco flavours to complement or contrast with the flavours from the tobacco. Commonly, liquid flavourants are incorporated into the filter of a smoking article during manufacture of the filter. For example, it is known to incorporate one or more flavour threads or flavour capsules containing a liquid flavourant into a filter for a smoking article. During smoking the liquid flavourant volatilises so that the flavourant is drawn through the filter with the mainstream smoke.

It has also been proposed to provide a liquid flavourant in a separate form, which can be applied to the smoking article by the consumer, prior to smoking. For example, US-A-2010/132723 discloses a device for applying a liquid flavourant to a cigarette filter prior to smoking, in which the filter is brought into contact with an adsorbent material including a flavour syrup, which is transferred into the filter.

It would be desirable to provide a novel device for enabling the consumer to conveniently and effectively incorporate a treatment agent, such as a flavourant, into a smoking article, prior to smoking. It would be particularly desirable if such a device could be adapted to enable the consumer to select from a variety of different treatment agents, such as a variety of flavourants. In addition, it would be desirable if the device for incorporating a treatment agent into a smoking article could be refillable and therefore reusable with multiple smoking articles.

According to the invention there is provided a device for treating at least a portion of a smoking article, the device comprising a base unit, a treatment unit and aerosol generating means. The base unit includes one or more elongate chambers for receiving at least a portion of a smoking article, each elongate chamber having an outlet; and one or more air plenums, each having an inlet. Each air plenum is in fluid communication with at least one of the one or more elongate chambers. The one or more air plenums comprises one or more annular channels surrounding the elongate chambers along at least a part of the length of the elongate chambers. The treatment unit includes one or more reservoirs for containing a liquid treatment agent, wherein each reservoir comprises means for providing fluid communication with an inlet of the one or more air plenums. The aerosol generating means is in fluid communication with the treatment unit for forming an aerosol from the liquid treatment agent in the one or more reservoirs.

Devices according to the invention can be used to conveniently apply a liquid treatment agent to one or more smoking articles or portions of smoking articles which are placed within the one or more elongate chambers. The arrangement of the components of the device is such that a flow pathway is provided between the reservoir containing the liquid treatment agent and the elongate chamber or chambers containing the smoking articles or portions of smoking articles.

During use of the device, the aerosol generating means is activated to produce an aerosol from a liquid treatment agent in one of the reservoirs in the treatment unit. The aerosol passes through the flow pathway from the reservoir through the inlet into the air plenum and onwards from the air plenum into the one or more elongate chambers. In the elongate chamber the aerosol is brought into contact with a smoking article and the treatment agent is absorbed into the smoking article. The outlet of each elongate chamber provides an outlet from the device, through which any remaining aerosol is released.

The term "treatment agent" is used to refer to any liquid agent that can be incorporated into a component of a smoking article in order to provide an effect on the smoke generated during smoking. The treatment agent may be, for example, a substance that is capable of reducing one or more constituents of the smoke. In preferred embodiments of the invention, the treatment agent is a liquid flavourant and the device is adapted for flavouring a smoking article or a portion of a smoking article.

In the following description, the invention will be described with reference to a device for flavouring a smoking article through the application of a flavouring agent. However, it will be clear that the teaching can also be applied to a device according to the invention for treating a smoking article with an alternative liquid treatment agent.

The application of a liquid flavourant to the smoking article in the form of an aerosol advantageously enables the flavourant to be effectively dispersed throughout the desired portion or portions of the smoking article and more readily absorbed through the outer wrappers and into the components of the smoking article. The flavoured smoking article may be ready for smoking immediately after removal of the smoking article from the device and does not typically require drying. Furthermore, unlike with devices of the prior art, the incorporation of the flavourant in the form of an aerosol into the smoking article advantageously does not typically alter the appearance or feel of the smoking article and the presence of the flavourant may not be apparent to the consumer other than in the mainstream smoke.

Devices according to the invention may be constructed with a compact arrangement of the base unit, treatment unit and aerosol generating means, such that the device may be handheld. Furthermore, the device can be constructed with a compact size which enables the device to be conveniently carried with the consumer, for example, in a bag or pocket, so that it is available for use at any time.

Devices according to the invention may be used to flavour a variety of types of smoking articles. For example, devices may be used to flavour filter cigarettes or other smoking articles in which tobacco material or another combustible material is combusted to form smoke. Alternatively, devices according to the invention may be used to flavour smoking articles in which material is heated to form an aerosol, rather than combusted. In one type of heated smoking article, tobacco material or another aerosol forming material is heated by one or more electrical heating elements to produce an aerosol. In another type of heated smoking article, an aerosol is produced by the transfer of heat from a combustible or chemical heat source to a physically separate aerosol forming material, which may be located within, around or downstream of the heat source.

Devices according to the invention may be used to treat all or a portion of a whole, assembled smoking article. In such cases, a complete cigarette may be introduced into the device and all or a portion of the cigarette may be treated by the device. For example, devices according to the invention may be used to flavour all or a portion of a filter in an assembled smoking article, all or a portion of a tobacco rod in an assembled smoking article, or all or a portion of the aerosol generating substrate of an assembled, non-combustible smoking article. In other cases, devices according to the invention may be used to treat all or a portion of any of these smoking article components separately from some or all of the other components of the smoking article. In such cases, the treated component can be subsequently incorporated into a smoking article.

In the present description any references to the flavouring of a "smoking article" apply equally to the flavouring of any of the smoking article components described above, either separately or when integral with another component of a smoking article.

The base unit of devices according to the invention incorporates one or more elongate chambers for receiving the smoking article or articles to be flavoured, and one or more air plenums in fluid communication with the one or more elongate chambers. The number of air plenums may be the same as or different to the number of elongate chambers, provided that each elongate chamber is in fluid communication with at least one air plenum. In some arrangements, a single air plenum may be provided for fluid communication with all of the elongate chambers. In other arrangements, a separate air plenum may be provided for each elongate chamber.

The term "air plenum" refers to an internal chamber, cavity or compartment within the device into which the aerosol is delivered upon formation from the liquid flavourant. The air plenum may allow the aerosol to distribute to, and in some cases along, a portion of each of the elongate chambers. The aerosol is delivered from the air plenum into one or more of the elongate chambers.

The one or more air plenums may take any suitable form. The form may depend upon the way in which the fluid communication is established between the air plenums and the elongate chambers. The one or more air plenums may extend part way around the elongate chambers, or all of the way around the elongate chambers. The one or more air plenums may extend part way along the length of the elongate chambers, or all of the way along the length.

In one preferred embodiment of the present invention, each air plenum comprises an annular channel surrounding one of the elongate chambers along at least a part of the length of the elongate chamber. This arrangement advantageously enables the flavourant to be applied relatively evenly around and along the smoking article within the chamber.

Depending upon the portion of the smoking article which is to be flavoured, the annular channel may extend along only a part of the elongate chamber or along the entire length of the elongate chamber. Preferably, the annular channel extends along at least the portion of the elongate chamber which will contain the portion of the smoking article to be flavoured. This is one of a number of alternative ways to selectively deliver the flavourant to a specific portion or component of the smoking article, such as the filter. Other ways are described in more detail below.

Each of the air plenums of devices according to the invention comprises an inlet which is adapted for fluid communication with one of the flavour reservoirs in the flavour unit. During use, the aerosol generated from the liquid flavourant in the flavour reservoir is delivered into the air plenum through the inlet. Preferably, the inlet of each air plenum comprises a valve arrangement. Particularly preferably, the valve arrangement includes a one way valve, non-return valve or check valve preventing the escape of the aerosol and any entraining gas through the inlet.

The air plenum is in fluid communication with the elongate chamber in order to form a fluid pathway from the aerosol generation device to the elongate chamber. The end or ends of each annular channel are preferably closed or sealed so that the aerosol does not escape through the end of the channel but is forced into the elongate chamber, as further described below.

The one or more elongate chambers of devices according to the invention may take any suitable form for receiving a smoking article and enclosing the smoking article whilst the flavourant is applied. Preferably, each elongate chamber is in the form of an elongate channel, orifice or passage having dimensions that are similar or slightly greater than that of a conventional smoking article. Preferably, a plurality of elongate chambers are provided within the same device to provide flexibility in the number of smoking articles that can be flavoured at the same time, or the type of flavourant that can be applied to the smoking article, as described in more detail below. For example, each elongate chamber may correspond to a different flavour type. Preferably, the number of elongate chambers within the base unit of devices according to the invention is between one and six, more preferably between two and four.

Each elongate chamber is in fluid communication with an associated air plenum so that during use the aerosol may effectively diffuse into the elongate chamber from the air plenum. The fluid communication may be achieved in a variety of ways which would be known to the skilled person. For example, a flow pathway may be established by means of one or more conduits extending between the air plenum and the elongate chamber. Alternatively, the air plenum may open into the elongate chamber through one or more holes or pores. Preferably, the fluid communication is provided such that the area over which the aerosol can diffuse from the air plenum into the elongate chamber is maximised.

Preferably, each elongate chamber is defined by a porous wall providing fluid communication between the elongate chamber and the associated air plenum. With this arrangement, the air plenum can conveniently be located immediately adjacent to the elongate chamber in order to provide an efficient and compact flow pathway. For example, where an elongate chamber is defined by a porous wall, the air plenum can conveniently be provided in the form of an annular channel surrounding the elongate chamber, as described above, wherein the porous wall provides the separation between the annular channel and the elongate chamber. During use, the aerosol flows directly from the air plenum through the pores in the porous wall into the elongate chamber.

The term "porous" is intended to encompass materials that are inherently porous as well as substantially non-porous materials that are made porous or permeable through the provision of a plurality of holes. The porous material must have pores of a sufficient size that the aerosol formed from the liquid flavourant can penetrate through the pores. Preferably, the pores in the porous wall defining the elongate chamber have an average dimension of less than about 3.0 mm, more preferably less than about 1.0 mm, most preferably less than about 0.5 mm. Alternatively or in addition, the pores have an average dimension that is greater than about 0.01 mm. Preferably, the pores have an average dimension that is between about 0.01 mm and about 3.0 mm, more preferably between about 0.01 mm and about 1.0 mm, and most preferably between about 0.01 mm and about 0.5 mm.

The average dimension of the pores is calculated by taking the average of the smallest dimension of each of the pores. The pore sizes may also vary along the length of the porous wall. The top of the porous wall (the portion closest to the aerosol generating means) may have less pores, or smaller holes, than the bottom or the porous wall (the portion furthest from the aerosol generating means).

The distribution of pores on the porous wall defining the elongate chamber may be adjusted depending upon the desired delivery of the flavourant to the smoking article. For example, the pores may only be provided in certain regions of the porous wall, corresponding to the portions of the smoking article to be flavoured. This enables the flavourant to be selectively applied along only a portion of the smoking article, such as the filter or the rod, or only a portion of the filter or rod.

In one particularly preferred embodiment of the invention, the base unit comprises one or more inner tubular members defining the one or more elongate chambers, wherein each of the inner tubular members is at least partially formed of a porous wall. The position and extent of the pores can be adjusted depending upon the desired location of flavour delivery, as described above. The use of inner tubular members provides a simple structure for defining the elongate chambers and for achieving the necessary fluid communication between the elongate chambers and the air plenum. Preferably, the inner tubular members are placed within elongate passages within the base unit, which have a larger diameter than the inner tubular members in order to provide an air plenum in the form of an annular channel around each inner tubular member.

Each elongate chamber comprises an outlet, wherein the outlet is provided for the evacuation of the elongate chamber after the aerosol has been applied to the smoking article within the elongate chamber. Preferably, the outlet is provided at one end of the elongate chamber. Preferably, the outlet of each elongate chamber comprises a valve arrangement for evacuating the chamber. Particularly preferably, the valve arrangement includes a one way valve, non-return valve or check valve allowing the aerosol and any entraining gas or air to exit the elongate chamber but preventing the ingress of air into the chamber through the outlet. The use of a valve of this type at the outlet may advantageously facilitate the flow of the aerosol through the flow pathway from the air plenum into the elongate chamber and out of the device.

Preferably, the end of the elongate chamber through which the smoking article is inserted is closed or sealed during the application of the flavourant aerosol to the smoking article within the elongate chamber. As such, a fluid pathway is defined from the air plenum, into the elongate chamber through the inner tubular member and out of the elongate chamber through the outlet.

The treatment unit of devices according to the invention includes one or more reservoirs for containing the liquid treatment agent to be applied to the smoking article or articles within the elongate chambers in the base unit. In relation to devices for flavouring a smoking article, the treatment unit is referred to as a "flavour unit" including one or more flavour reservoirs.

The term "reservoir" refers to a chamber or compartment within the flavour unit which is capable of storing the liquid flavourant in such a way that an aerosol can be generated from the liquid flavourant and transferred into the air plenum. The flavour unit is connected to the aerosol generating means so that the liquid flavourant in the flavour reservoir can be aerosolised during use. The nature of the connection between the flavour unit and the aerosol generating means will depend upon the mechanism provided for aerosol generation, as discussed below.

Each flavour reservoir of the flavour unit is adapted for connection with an inlet of the one or more air plenums and therefore has a structure which is adapted to provide a fluid pathway between the flavour reservoir and the air plenum for delivering the aerosol into the air plenum during use. In some cases, a permanent connection may be provided between each fluid reservoir and an inlet of the one or more air plenums. In other cases, the flavour reservoir may not be in fluid communication with the air plenum at all times but is instead adapted to be brought into fluid communication with the air plenum prior to use of the device to flavour a smoking article. This arrangement may advantageously prevent the inadvertent activation of the device to produce an aerosol between uses.

The number of flavour reservoirs in the flavour unit may be the same as or different to the number of elongate chambers within the base unit.

The flavour unit of devices according to the present invention may include a single flavour reservoir containing a single type of liquid flavourant. Preferably, the single flavour reservoir is adapted to contain sufficient liquid flavourant to flavour a plurality of smoking articles without replacement. The single flavour reservoir may be fluidly connected to the inlet of a single air plenum, or each inlet of a plurality of air plenums. In certain embodiments the flavour unit may incorporate a diffusion device which facilitates the diffusion of the aerosol generated from the liquid flavourant in the flavour reservoir into a plurality of air plenums. For example, the diffusion device may be an open space or an additional plenum that facilitates the distribution of the aerosol into multiple air plenums discussed earlier. This enables the simultaneous flavouring of a plurality of smoking articles.

Preferably, the flavour unit includes a plurality of flavour reservoirs, each adapted for containing a separate portion of a liquid flavourant. The liquid flavourant in each flavour reservoir may be the same as or different from one another. Preferably, each flavour reservoir is used to contain a different type of liquid flavourant so that the flavour unit advantageously provides a variety of available flavour options to the consumer. The consumer may select which of the available flavours to apply to the one or more smoking articles within the base unit, as further described below. Devices according to the invention therefore offer improved flexibility in the flavouring of smoking articles.

The liquid flavourant is preferably incorporated into the one or more flavour reservoirs of devices according to the invention in such a way that the flavourant can be stored within the flavour unit between uses. Preferably, each flavour reservoir is adapted such that it can be refilled with liquid flavourant as required in order to re-use the device.

Preferably, each flavour reservoir comprises a flavour cartridge containing the liquid flavourant. The flavour cartridges are preferably replaceable within the flavour unit. This enables the liquid flavourant to be replaced or refilled by the consumer in a simple and efficient way. The consumer is able to select and insert a flavour cartridge into the device containing the desired flavourant and to remove and discard the empty cartridge after use so that the device can be re-used for the flavouring of multiple smoking articles.

Suitable liquid flavourants for flavouring smoking articles would be known to the skilled person. The flavourants may comprise natural extracts, synthetic flavours, or a combination thereof. Flavourants that may be applied to smoking articles within the device include, but are not limited to, menthol, mint including spearmint and peppermint, eucalyptus, vanilla, cocoa, chocolate, coffee, tea, spices (such as cinnamon, clove and ginger) and fruit flavourants.

The present invention encompasses devices in which the flavour reservoirs are empty but are suitable for receiving a liquid flavourant prior to use. In addition, the present invention encompasses devices in which one or more flavour reservoirs are stocked or loaded with a portion of a liquid flavourant.

The liquid flavourant within the one or more flavour reservoirs may advantageously be provided within a porous carrier material or 'matrix'. This makes the liquid flavourant more available so that in most cases an aerosol can more readily be generated from the liquid flavourant than if the liquid were provided without a carrier. In addition, the use of a porous carrier material allows for the flow of air or other gases through the flavour reservoir which may assist with the production of an aerosol or the dispersion of the aerosol through the flow pathway within the device.

The porous carrier material may be formed of any suitable porous material that is capable of absorbing or adsorbing the liquid flavourant and retaining it until an aerosol is generated. Suitable materials include but are not limited to woven or non-woven fibres of polyethylene (PE), polypropylene (PP), polytetrafluoroethylene (PTFE), polyethylene terephthalate (PET or PETG), polybutylene terephthalate (PBT). Preferably, the porous carrier material is a wicking material that facilitates the production of an aerosol from the liquid flavourant.

The flavour unit is connected to the aerosol generating means in such a way that each flavour reservoir is permanently connected to the aerosol generating means or can be brought into connection with the aerosol generating means in order to generate an aerosol from the liquid flavourant in that reservoir.

In certain preferred embodiments, the flavour unit comprises a plurality of flavour reservoirs and the flavour unit is moveable relative to the aerosol generating means in order to selectively bring each flavour reservoir into engagement with the aerosol generating means. The term 'engagement' refers to the bringing together of the aerosol generating means and the flavour reservoir in such a way that an aerosol can be generated from the liquid flavourant within the reservoir. The type of engagement will depend upon the nature of the aerosol generating means, which will be described in more detail below. In certain preferred cases, the aerosol generating means is brought into fluid communication with each of the flavour reservoirs.

With the moveable flavour unit, only one flavour reservoir is typically engaged with the aerosol generating means at any one time and the consumer can select which flavour reservoir to deliver the flavour from. This arrangement is particularly advantageous when the flavour reservoirs are filled with different types of liquid flavourant, since it enables the consumer to readily select one of a number of available flavours.

The flavour unit may be continuously moveable relative to the aerosol generating means, wherein the consumer must determine the correct position of the flavour unit. More preferably, the flavour unit is moveable between a number of discrete positions corresponding to each of the plurality of flavour reservoirs. This enables the consumer to conveniently index the flavour unit between the different, discrete positions and provides improved precision in the alignment of the flavour reservoir and the aerosol generating means. In both cases, the device may advantageously be provided with external markings or other indicators in order to assist the consumer in selecting the desired position of the flavour unit.

In some cases, it may be desirable to provide an 'off' position in which the flavour unit is positioned such that none of the flavour reservoirs is engaged with the aerosol generating means and an aerosol cannot be generated. Preferably, the device comprises means for releasably locking the flavour unit in the 'off' position. This advantageously prevents the inadvertent activation of the device between uses.

The aerosol generating means of devices according to the present invention may include any suitable device and structure for the generation of an aerosol from the liquid flavourant contained within the one or more flavour reservoirs of the flavour unit. Suitable devices would be known to the skilled person.

In preferred embodiments of the invention, the aerosol generating means comprises a supply of compressed air or other gas which is adapted for fluid communication with the one or more flavour reservoirs. The supply of compressed gas will typically comprise an outlet nozzle, which must be brought into fluid communication with a fluid reservoir in order to eject the compressed gas into the flavour reservoir to form an aerosol from the liquid flavourant contained within. Preferably, the supply of compressed gas is provided above the flavour reservoir so that the gas is forced through the reservoir in a downwards direction. Other orientations of the supply of compressed gas and the flavour reservoir may also be suitable.

Upon activation, the supply of compressed gas ejects a pressurised stream of gas through the flavour reservoir in order to form an aerosol of small droplets of the liquid flavourant. The supply of compressed gas is preferably activated to provide a predetermined volume of gas, which is released as a substantially continuous stream over a predetermined time period. The droplets of the liquid flavourant are entrained in the stream of gas and are forced through the flow pathway in the device together with the pressurised gas, through the associated air plenum and into the one or more elongate chambers of the base unit. The use of a supply of compressed gas is therefore particularly convenient since it not only generates the aerosol from the liquid flavourant but forces the aerosol through into the elongate chamber so that the smoking article within the chamber can be flavoured within a short period of time.

Advantageously, the supply of compressed air or gas can be incorporated into the device such that it may readily be refilled or replaced when the gas has been used. This enables the device to be re-used for the flavouring of other smoking articles.

In alternative embodiments of the invention, the aerosol generating means may comprise a heater arrangement for generating an aerosol from the liquid flavourant through heating of the flavourant to bring about volatilisation. Where a heater arrangement is incorporated, the aerosol generating means may include a capillary passage arrangement for facilitating the volatilisation of the liquid flavourant. In further alternative embodiments, the aerosol generating means may comprise a vibration device such as a piezoelectric element, for generating an aerosol from the liquid flavourant through vibration of the surface of the flavourant.

Where the aerosol generating means includes means other than compressed gas for generating an aerosol, the device may in any case further comprise a supply of compressed gas to act as a propellant for forcing the aerosol through the flow pathway, as described above.

The aerosol generating means of devices according to the invention preferably comprises actuation means for actuating the generation of an aerosol from the liquid flavourant within one or more of the flavour reservoirs. The actuation means will depend upon the nature of the aerosol generating means but may include, for example, a switch to be used to actuate a heater or piezoelectric device, or a button or other compressible means for actuating emission of compressed gas from a supply.

Devices according to the present invention may further comprise a selection unit provided between the flavour unit and the aerosol generating means, wherein the selection unit includes means for providing fluid communication between the aerosol generating means and at least one of the flavour reservoirs in the flavour unit. The selection unit finds particular application in devices incorporating a supply of compressed gas as the aerosol generating means. In such cases, the selection unit preferably provides one or more conduits or passageways for directing the compressed gas stream from the supply of compressed gas to the appropriate flavour reservoir. Each conduit or passageway preferably extends through the selection device from a first end adjacent the aerosol generating means to a second, opposite end adjacent the flavour unit.

Preferably, the selection unit is moveable relative to the flavour unit between one or more active configurations in which the selection unit provides fluid communication between the aerosol generating means and the desired flavour reservoir, and an inactive configuration in which the aerosol generating means and the one or more fluid reservoirs are not in fluid communication. The number of active configurations of the selection unit will typically correspond to the number of flavour reservoirs so that the flavour reservoirs can be selectively brought into fluid connection with the aerosol generating means. In the inactive configuration, an aerosol cannot be generated. Preferably, the device includes means for releasably locking the selection unit in the inactive configuration. This advantageously prevents the inadvertent activation of the device between uses.

As described above in relation to the moveable flavour unit, the selection unit is preferably moveable between a number of discrete positions corresponding to each of the active configurations and the inactive configuration. This enables the consumer to conveniently index or 'click' the selection unit between the active configurations and the inactive configuration. It also provides improved precision in the alignment of the selection unit with both the flavour reservoir and the aerosol generating means. The device may advantageously be provided with external markings or other indicators in order to assist the consumer in selecting the desired position of the selection unit.

The flavour unit and the aerosol generating means may be provided together in a lid unit removably connected to the base unit. Where a selection unit is provided between the flavour unit and the aerosol generating means, this may also be incorporated into the lid unit. The lid unit is preferably moveable between an open position, in which a smoking article can be inserted into one of the elongate chambers in the base unit, and a closed position, in which the one or more elongate chambers are closed and a flavour can be applied to the smoking article. In certain embodiments, locking means may be provided for locking the lid unit in the closed position. Alternatively or in addition, guide means may be provided for guiding the lid unit into the closed position.

The incorporation of a lid unit into devices according to the invention provides a convenient way for the consumer to open and close the elongate chambers within the base unit. Preferably, the lid unit is separable from the base unit and can be easily detached from the flavour unit and aerosol generating means so that it can be washed or cleaned to avoid flavour contamination of the elongate chambers.

The lid unit may be connected to the base unit by a hinge type mechanism so that the lid unit may be pivoted between the open position and the closed position. Alternatively, screw threads may be provided on the base unit and the lid unit for screwing the lid unit in place. In another alternative, the lid unit may be a friction fit over the base unit so that the consumer can slide the lid unit between the open position and the closed position. Preferably, in the closed position of the lid unit there is an airtight seal between the base unit and the lid unit in order to prevent leakage of the aerosol during use. Where the aerosol generating means comprises a supply of compressed air, an adequate seal between the lid unit and the base unit is important in order to ensure the passage of the compressed air stream through the fluid pathway and to the one or more elongate chambers, as described above.

Devices according to the invention are preferably oriented with the base unit at the bottom and the lid unit at the top of the device. However, the devices may be oriented in alternative ways, for example, with the base unit at the top and the lid unit at the bottom of the device, or with the lid unit on one side of the base unit.

Devices according to the invention may take any suitable form and the size and shape of the device may be adapted to suit the size and number of smoking articles to be flavoured. For example, the device may be substantially cylindrical with a circular, oval, square or rectangular cross section. Preferably, the length of the device is between about 10 cm and about 20 cm and the width of the device is between about 2 cm and about 6 cm. Devices with these dimensions are suitable for use as handheld devices which can be carried by the consumer in a bag or pocket. Preferably, the device is provided with an outer casing containing the components for flavouring a smoking article, so that the device can be carried around between uses without risk of damage.

The external surfaces of devices according to the invention may be provided with graphics or indicia incorporating, for example, branding, manufacturer or product information. Marking may be provided on the external surface in order to assist the consumer in operating the device, as discussed above.

According to the invention there is also provided a use of the device described above for flavouring a smoking article, wherein the smoking article is placed in an elongate chamber of the base unit, a liquid flavourant is provided in a flavour reservoir of the flavour unit and an aerosol generating means is activated in order to produce an aerosol from the flavour reservoir.

As described above, the device incorporates a flow pathway between each flavour reservoir and one or more of the elongate chambers so that upon generation of an aerosol from the liquid flavourant within the reservoir, the aerosol flows through the device into the elongate chamber. In the elongate chamber, the aerosol is at least partially deposited onto or absorbed into the smoking article within the chamber to provide additional flavour to the smoking article. The flavourant that is incorporated within the smoking article will subsequently be released during smoking of the smoking article.

According to the present invention there is further provided a smoking article adapted for use with a device according to the invention, as set out above. The smoking article is preferably adapted such that it can readily be received into an elongate chamber within the base unit of the device. For example, the length of the smoking article may be adapted to correspond to the length of the elongate chamber. Alternatively or in addition, the diameter of the smoking article may be adapted depending on the diameter of the elongate chamber. In other examples, the cross sectional shape of the smoking article may be adapted such that the shape of the smoking article is compatible with the shape of the elongate chamber.

According to the present invention there is further provided a kit for providing a flavoured smoking article, the kit comprising a device according to the invention for flavouring a smoking article, as described above, and one or more smoking articles. Preferably, the kit additionally comprises one or more flavour cartridges containing a liquid flavourant. The device and the one or more smoking articles within the kit are preferably adapted to be compatible with each other. For example, the shape and dimensions of the smoking article are preferably selected to be compatible with the elongate chamber into which the smoking article will be inserted, as described above.

Figure 2:
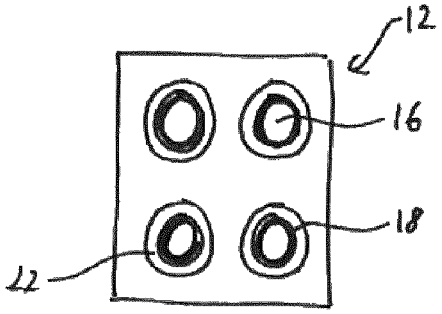

The invention will now be further described, by way of example only, with reference to the accompanying drawings in which:

FIG. 1 (not to scale) shows a schematic longitudinal cross section of a device according to the present invention for flavouring one or more filter cigarettes, with the lid unit separated from the base unit; and FIG. 2 (not to scale) shows a top view of the base unit of the device of FIG. 1.

The flavouring device 10 shown in FIG. 1 is a rectangular parallelepiped in shape and comprises a base unit 12 and a lid unit 14. In FIG. 1 the device 10 is shown in an open position, with the lid unit 14 separated from the base unit 12. Before operation of the device 10 to flavour one or more filter cigarettes, the lid unit 14 may be secured in place on the top of the base unit 12.

The base unit 12 comprises four spaced apart elongate chambers 16, each shaped and sized to receive a filter cigarette. As shown in FIG. 2, the elongate chambers 16 have a circular transverse cross section with a diameter that is greater than the diameter of a conventional filter cigarette. The length of each elongate chamber 16 is such that the full length of a conventional filter cigarette can be received within the chamber.

Each elongate chamber 16 is defined by an inner tubular member 18 formed of a porous material. The top end of each elongate chamber 16 is open at the top end of the base unit so that a filter cigarette can be inserted into the chamber when the lid unit 14 is removed from the base unit as shown in FIG. 1. Each chamber 16 extends vertically through the base unit to an outlet 20 at the bottom end of the base unit 12. At the outlet 20 of each elongate chamber 16 a check valve is provided to allow for evacuation of the chamber 16 during use.

Each of the four inner tubular members 18 is disposed within the centre of an elongate passage extending vertically through the base unit 12. The inner diameter of the elongate passages is greater than the outer diameter of the inner tubular members 18 so that an annular channel 22 is formed around each tubular member 18, forming an air plenum. An inlet 24 is provided at the top end of each of the annular channels 22. The opposite, bottom end of each annular channel 22 is sealed closed.

The lid unit 14 comprises a flavour unit 26 at the bottom end, a selection unit 28 connected above the flavour unit 26, and an aerosol generating system 28 connected above the selection unit 28 at the top of the lid unit 14.

The flavour unit 26 comprises four separate flavour reservoirs 32, each of which comprises a flavour cartridge (not shown) containing a liquid flavourant within a porous carrier material. A different type of flavourant may be stored in each flavour reservoir, if desired, and each flavour reservoir corresponds to a particular one of the elongate chambers. Each flavour reservoir 32 comprises an inlet 34 for receiving compressed air from the aerosol generating system 30, as described below. An outlet 36 is also provided in each flavour reservoir 32 for providing fluid communication between the flavour reservoir 32 and one of the annular channels 22 in the base unit 12. The bottom of the lid unit 14 is adapted so that it closes or seals the top end of the elongate chamber 16 when the lid unit 14 is in place on the base unit 12, while allowing the fluid communication into the annular channels 22.

The selection unit 28 is connected at the top end of the flavour unit 26 and the selection unit 28 and the flavour unit 26 are rotatable relative to each other between four discrete positions corresponding to each of the four flavour reservoirs 32. The selection unit 28 comprises a single passageway 38 extending between the top and bottom ends of the selection unit 28 and comprising a valve at each end. The bottom end of the passageway 38 is adapted for connection with the inlet 34 of each flavour reservoir 32. The selection unit 28 may be rotated in order to selectively connect the passageway 38 with each of the four flavour reservoirs 32.

The aerosol generating system 30 comprises a supply of compressed air 40 with an outlet valve 42 for supplying the compressed air into the passageway 38 of the selection unit 28. The supply of compressed air 40 comprises an actuator button 44 which is located at the top end of the lid unit 14 and which is pushed downwards by the consumer in order to actuate the device during use.

Before use of the device 10 the consumer inserts a flavour cartridge containing a liquid flavourant into the flavour unit. In some cases, the flavour unit 26 may be pre-loaded with cartridges in one or more of the flavour reservoirs 32.

During use of the device 10 the consumer must remove the lid unit 14 from the base unit 12 as shown in FIG. 1 and insert a filter cigarette into the elongate chamber 16 corresponding to the desired flavour. The cigarette is inserted with the filter end of the cigarette first so that the filter is positioned at the bottom end of the elongate chamber 16. The lid unit 14 is then secured in place on the base unit 12 so that the top ends of the elongate chambers 16 are sealed shut.

The consumer rotates the selection unit 28 relative to the flavour unit 26 in order to line up the passageway 38 of the selection unit with the inlet 34 of the flavour reservoir 32 containing the desired flavourant for application to the smoking article within the corresponding elongate chamber 16.

The consumer then presses the actuator button 44 in a downwards direction causing a stream of compressed air to be ejected from the outlet 42 of the supply of compressed air 40 for several seconds. The compressed air steam is forced through the passageway 38 in the selection unit and through the flavour reservoir 32 via the inlet 34. The stream of compressed air with droplets of the liquid flavourant entrained in it then passes through the outlet of the flavour reservoir into the annular channel 22 surrounding the elongate chamber 16 containing the smoking article. The aerosol passes through the porous wall of the inner tubular member 18 defining the elongate chamber and is absorbed into the filter cigarette within the chamber. The stream of air is then evacuated through the valve at the outlet of the elongate chamber 16.

After flavouring of the cigarette is complete, the consumer can remove the lid unit and remove the flavoured cigarette from the base unit for immediate smoking.

It will be appreciated that a device of a similar construction could be used to apply a different type of liquid treatment agent to a smoking article.

The invention claimed is:

1. A device for treating at least a portion of a smoking article, the device comprising:

a base unit including:

one or more elongate chambers adapted to receive at least a portion of a smoking article, each elongate chamber having an outlet; and one or more air plenums, each having an inlet, wherein each air plenum is in fluid communication with at least one of the one or more elongate chambers, and wherein the one or more air plenums comprises one or more annular channels, the one or more annular channels surrounding the elongate chambers along at least a part of the length of the elongate chambers;

a treatment unit including one or more reservoirs adapted to contain a liquid treatment agent, wherein each reservoir is in fluid communication with the one or more inlets of the one or more air plenums; and an aerosol generating element in fluid communication with the treatment unit for forming an aerosol from the liquid treatment agent in the one or more reservoirs.

2. A device according to claim 1 wherein the one or more elongate chambers are each defined by a porous wall providing fluid communication between the elongate chamber and the associated air plenum.

3. A device according to claim 1 comprising one or more inner tubular members defining the one or more elongate chambers, wherein each of the inner tubular members is at least partially formed by a porous wall.

4. A device according to claim 1 wherein the aerosol generating element comprises a supply of compressed gas and is in fluid communication between the aerosol generating element and the one or more reservoirs.

5. A device according to claim 1 wherein the treatment unit and aerosol generating element are provided in a lid unit and wherein the lid unit is moveable between an open position, in which at least a portion of a smoking article can be inserted into one of the elongate chambers in the base unit, and a closed position, in which the one or more elongate chambers are closed and a treatment agent can be applied to the portion of the smoking article.

6. A device according to claim 1 wherein the treatment unit comprises a plurality of reservoirs and wherein the treatment unit is moveable relative to the aerosol generating element in order to selectively bring each reservoir into engagement with the aerosol generating element.

7. A device according to claim 1 further comprising a selection unit provided between the treatment unit and the aerosol generating element, wherein the selection unit is fluid communication between the aerosol generating element and at least one of the reservoirs of the treatment unit.

8. A device according to claim 7 wherein the selection unit is moveable relative to the treatment unit between one or more active positions in which the selection unit provides fluid communication between the aerosol generating element and one of the reservoirs and an inactive position in which the aerosol generating element and the one or more reservoirs are not in fluid communication.

9. A device according to claim 1 wherein the aerosol generating element comprises an actuator for actuating the generation of an aerosol from a liquid treatment agent in the one or more reservoirs.

10. A device according to claim 1 wherein the outlet of each elongate chamber comprises a valve.

11. A device according to claim 1 wherein each of the one or more reservoirs comprises a liquid treatment agent in a porous carrier material.

12. A device according to claim 1 wherein the treatment unit is refillable or replaceable.

13. A device according to claim 2 comprising one or more inner tubular members defining the one or more elongate chambers, wherein each of the inner tubular members is at least partially formed by a porous wall.

14. A device according to claim 2 wherein the aerosol generating element comprises a supply of compressed gas and is in fluid communication between the aerosol generating element and the one or more reservoirs.

15. A device according to claim 3 wherein the aerosol generating element comprises a supply of compressed gas and is in fluid communication between the aerosol generating element and the one or more reservoirs.

16. A device according to claim 13 wherein the aerosol generating element comprises a supply of compressed gas and is in fluid communication between the aerosol generating element and the one or more reservoirs.

17. A device according to claim 2 wherein the treatment unit and aerosol generating element are provided in a lid unit and wherein the lid unit is moveable between an open position, in which at least a portion of a smoking article can be inserted into one of the elongate chambers in the base unit, and a closed position, in which the one or more elongate chambers are closed and a treatment agent can be applied to the portion of the smoking article.

18. A device according to claim 3 wherein the treatment unit and aerosol generating element are provided in a lid unit and wherein the lid unit is moveable between an open position, in which at least a portion of a smoking article can be inserted into one of the elongate chambers in the base unit, and a closed position, in which the one or more elongate chambers are closed and a treatment agent can be applied to the portion of the smoking article.

19. A device according to claim 4 wherein the treatment unit and aerosol generating element are provided in a lid unit and wherein the lid unit is moveable between an open position, in which at least a portion of a smoking article can be inserted into one of the elongate chambers in the base unit, and a closed position, in which the one or more elongate chambers are closed and a treatment agent can be applied to the portion of the smoking article.

* * * * *